US006799757B1

(12) United States Patent
Lang

(10) Patent No.: US 6,799,757 B1
(45) Date of Patent: Oct. 5, 2004

(54) POSITIONING IN A RETAINING DEVICE

(76) Inventor: Günter Lang, Goethestrasse 40/1, D-73249 Wernau (DE)

( * ) Notice: Subject to any disclaimer, the term of this patent is extended or adjusted under 35 U.S.C. 154(b) by 0 days.

(21) Appl. No.: 10/054,975

(22) Filed: Jan. 25, 2002

(51) Int. Cl.[7] ..... H01J 9/227
(52) U.S. Cl. ..... 269/266; 269/267
(58) Field of Search ..... 269/266, 267, 269/20, 283, 285

(56) References Cited

U.S. PATENT DOCUMENTS

| | | | | |
|---|---|---|---|---|
| 1,453,176 A | * | 4/1923 | Perrine | 269/266 |
| 2,882,771 A | * | 4/1959 | Blazek | 269/266 |
| 5,152,707 A | * | 10/1992 | Dougherty et al. | 269/266 |
| 5,544,872 A | * | 8/1996 | Schuit | 269/266 |
| 6,345,816 B1 | * | 2/2002 | Fitzpatrick | 269/266 |

FOREIGN PATENT DOCUMENTS

| | | |
|---|---|---|
| EP | 0 761 382 | 3/1997 |

* cited by examiner

*Primary Examiner*—Robert C. Watson
(74) *Attorney, Agent, or Firm*—Venable LLP; Stuart I. Smith

(57) ABSTRACT

A workpiece can be clamped between the jaws of a vise in a defined position easily when it is supported by positioning pins. They are located in a plurality of bores in the jaw and can be projected out of the jaw in operation. The pins comprise a pin body and a stop member. Both elements provide a shape which allows an economical production and easy connection with each other. In normal operation the pins can be projected out of the jaw by fluid pressure and be pushed back manually. A bent pin can be pushed or pulled to the front out of the jaw easily by destroying the stop member in a predetermined way or separating it from the pin body.

25 Claims, 5 Drawing Sheets

POSITIONING IN A RETAINING DEVICE

BACKGROUND OF THE PRESENT INVENTION

The present invention relates to a clamping device for positioning workpieces. Such devices are used in vises for example to position a workpiece precisely before its procession by drilling, milling etc. The requirements concerning procession have been increasing and demand a more precise positioning. On the other hand the vise should be easy to handle and the positioning should not take a long set-up time.

DESCRIPTION OF THE PRIOR ART

Positioning devices are known from the prior art. EP 0 761 382 A1 discloses a jaw of a vise for example, which provides a plurality of bores in several horizontal rows in its main body. Positioning pins are slidably located in the bores and can be moved between an active position, in which they project out of the bores, and an inactive position, in which they do not project out of the bores. The workpiece rests at the pushed out pins when clamping between the jaws. The pins can be moved from the inactive position into their active position row by row using pressurized air or another fluid. It is injected via pressurization channels in the jaw into fluid chambers and pushes the pins into their active position. Depending on the shape of the workpiece not all pins are required for support. Some can be pushed back manually pin by pin into the main body of the jaw. Any undesired movement of positioning pins in the bores is prevented by friction, which is strong enough to keep the pins in the active or inactive position, but can be overcome easily by the force applied to the pin manually or by pressurized fluid in the fluid chamber.

This results in both a short set-up time for adapting the vise to a new workpiece and a precise positioning because of the known arrangement of the pins. A plurality of pins is needed, which are rather expensive because of the following requirements:

By pressurizing the air supply the pins must not be pushed out of the jaw, but be held in a defined active position. So they provide a head, which cannot pass through the bore because it is larger than the diameter of the bore. The pins known from the prior art are of piston shape providing two coaxial cylindric sections. When the end surface of the larger section is exposed to pressurized air a part of the smaller section will be projected out of the bore and be stopped in the active position.

The precision of positioning of a workpiece depends on the precision of the radial location of the pins which carry the workpiece before it is clamped in the clamping device. So small work tolerances of pins and bores are required which increase cost.

A pin in the active position can be damaged by a radial shock from the workpiece, for example if it is not put into the clamping device carefully. The hit pin may be bent and stuck in the bore, because after the shock it cannot be removed out of the bore neither to the front (because of its head located in the fluid chamber) nor to the back (because of its bent section being projecting out of the bore), so the whole jaw could become useless. In the prior art the pins provide a predetermined breaking point. If a pin which is in its active position is hit strongly its section which is projected out of the bore is broken off. The remnant of the pin can be moved to the back out of the bore and can be replaced by a new pin easily after removing the rear covering of the jaw.

The required piston shape of the pins and the predetermined breaking point in the smaller section result in a complicated design and rather high production cost, so they are the object of improvements.

SUMMARY OF THE INVENTION

The aim of the present invention is to overcome the drawbacks of the prior art by providing pins which fulfill the requirements and cause less production cost because of an easier construction. This object is attained by a positioning device according to claim 1 or a positioning pin according to claim 2.

No predetermined breaking point is necessary as is the case in the prior art for easy removal of damaged pins from the back side. In the present invention the predetermined breaking point is dispensable, because a bent pin can be removed to the front instead of the back side of the jaw. The piston shaped pin does only have one cylindric section with no different diameters which is rather inexpensive. The positioning pin of the present invention comprises a pin body which does not exceed an imaginary enveloping cylindric surface being the axial prolongation of the bore in which it is located, for example a cylinder. The pin body is connected with a stop member which does exceed the imaginary enveloping cylindric surface being the axial prolongation of the bore. In normal operation the pin cannot completely pass through the bore because of the stop member. If necessary a damaged pin can be removed by deforming or destroying the stop member in the working chamber by applying a force directed to the front to the pin body which is greater than the force applied by pressurized fluid in the working chamber. Three preferred embodiments are described below.

DESCRIPTION OF THE PREFERRED EMBODIMENTS

Figure 1:
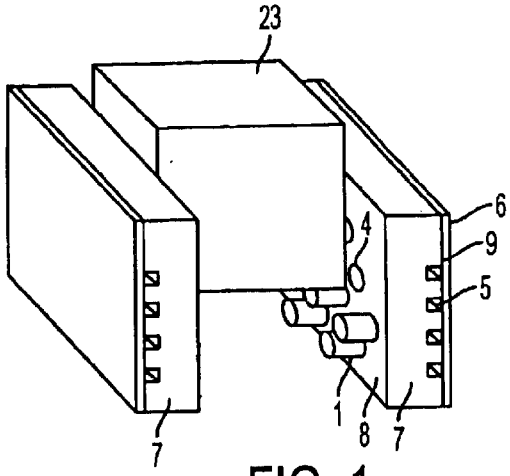
FIG. 1 is a schematic illustration of a workpiece clamped in a vise between two jaws being embodiments of the present invention.
Figure 2:
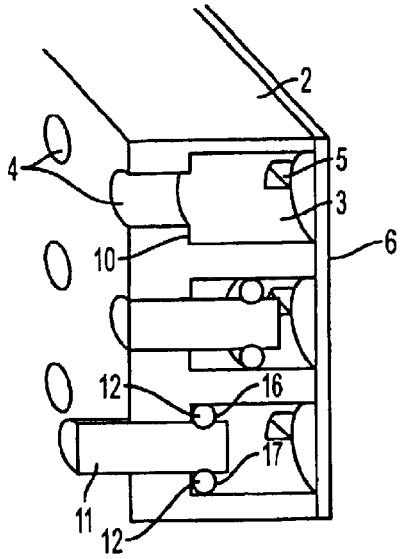
FIG. 2 is a schematic illustration of a sectional view of a jaw with positioning pins of the present invention located in bores in its main body.
Figure 3:
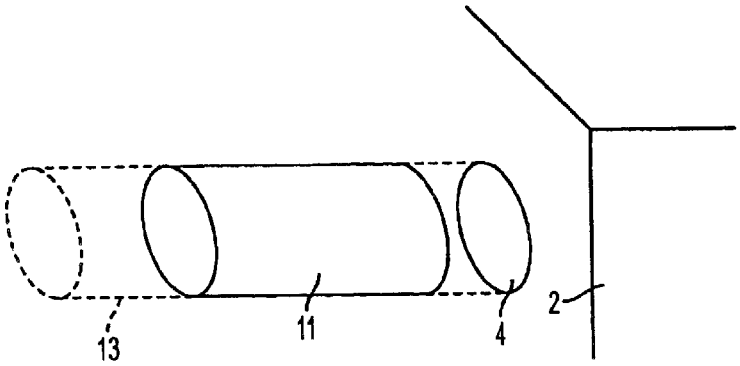
FIG. 3 shows a pin body of the present invention which is not exceeding an imaginary enveloping cylindric surface being the axial prolongation of one bore.
Figure 4:
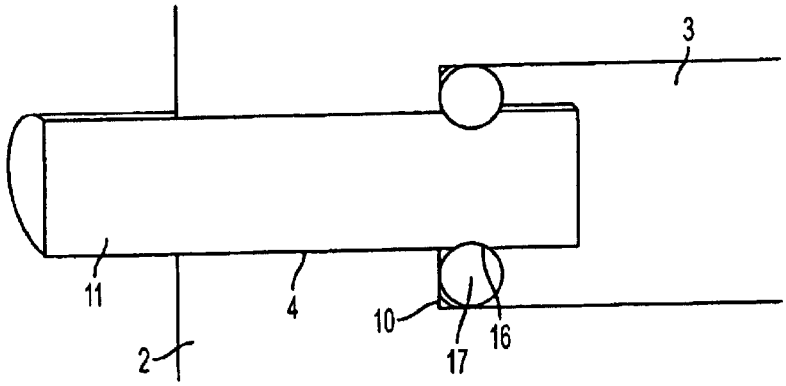
FIG. 4 is a sectional view of a positioning pin of the first embodiment of the present invention, the pin being in its active position.
Figure 5:
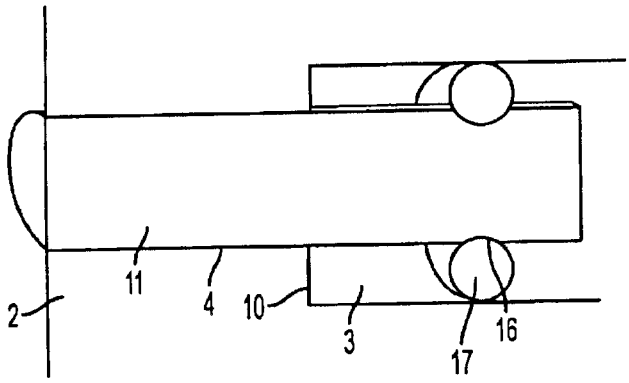
FIG. 5 is a sectional view of the pin of FIG. 4 in its inactive position.
Figure 6:
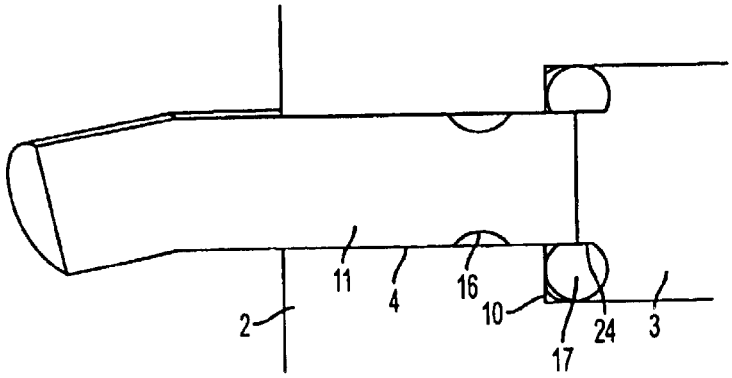
FIG. 6 is a sectional view of the pin of FIG. 4 being bent and removed from the bore by a force applied to the pin body and directed to the front, the outer part of the O-ring-seal being sheared off.

The first embodiment of the present invention is shown in FIGS. 4, 5 and 6. It comprises a jaw 7 which is adapted to clamp a workpiece 23 in a vise. The jaw 7 provides a main body 2 having a front face 8 and an opposite rearward face 9. The main body 2 provides a plurality of parallel, cylindric through bores 4 passing from the front face 8 to the rearward face 9 of said jaw 7, all bores 4 providing the same diameter. The bores 4 are arranged in parallel, horizontal, equidistant lines. The bores 4 within each line are preferably equidistant, too. The distance of two neighboring bores within one line equals two times the distance of two neighboring lines. There may be a shift between neighboring lines of the amount of half the distance of neighboring bores within each line. As the result the jaw provides diagonal lines of bores 4 which enclose an angle of 45 degrees in relation to the parallel, horizontal lines of bores 4. The diagonals of positioning pins 1 can be used to support a workpiece 23 providing outer surfaces enclosing an angle of 45 or 135 degrees. At the rearward face 9, each bore opens into a fluid chamber 3 which is cylindric, being coaxial with the bore 4 and having a larger diameter than the bore 4. A transition section 10 is located between the bore 4 and the fluid chamber 3. The transition section 10 is a radial surface forming a shoulder between the bore 4 and the fluid chamber 3. The jaw 7 provides a rearward covering 6 which covers all fluid chambers 3 in the main body 2. The main body 2 provides fluid channels 5, which pass through all fluid chambers 3 of one line each and open to a lateral face of the main body 2. The opening of each fluid channel 5 is adapted to be connected with a fluid supply means, for example a source of pressurized air.

The first embodiment of the present invention further comprises a plurality of positioning pins 1, each pin providing a pin body 11 and a stop member 12. The pin body 11 is made of steel, cylindric and providing a diameter which is somewhat smaller than the diameter of the bores 4. It is adapted to be slidably received in one of the bores 4. The pin body 11 is longer than the bore 4 and does not provide a shoulder as known from the prior art or any other part which is exceeding an enveloping cylindric surface 13 of the sane diameter as the bore 4 which is the axial prolongation of the bore 4. The pin body 11 provides a front face 14 at its front end and a rearward face 15 at its rearward end. Next to the rearward face 15 the cylindric surface of the pin body 11 provides a ring groove 16 carrying an O-ring-seal 17. The inner part of the O-ring-seal 17 is located in the ring-groove 16, provides an inner diameter smaller than the cylindric surface of the pin body 11 and prevents a axial shift of the O-ring-seal 17 along the pin body 11. The outer part of the O-ring-seal 17 is exceeding the enveloping cylindric surface 13. The outer diameter of the O-ring-seal 17 is adapted to the inner diameter of the fluid chambers 3 to be slidably received therein. The stop member of the first embodiment of the present invention does not necessarily have to seal.

In normal operation one pin 1 is located in each bore 4. A part of the pin body 11 is located in the bore 4 and slidably received therein. The O-ring-seal 17 is located in the fluid chamber 3 and slidably received therein. The pin can be shifted at least between an active position and an inactive position. In the active position the front end of the pin body 11 is projected out of the bore 4 exceeding the front face 8 of the jaw 7. The O-ring-seal 17 is in contact with the transition section 10. In the inactive position the front face 14 of the pin body 11 is located in a plane defined by the front face 8 of the jaw 7. The O-ring-seal 17 is not in contact with the transition section 10.

The pins 1 can be moved from the inactive position to the active position by pressurized fluid in the fluid chambers 3. A source of pressurized fluid, for example pressurized air, can be connected to one of the fluid channels 5 to pressurize one row of fluid chambers 3. As the result all pins associated therewith are pushed into the active position by the force applied to the rear face 15 of the pin body and the O-ring-seal 17 by pressurized fluid in the fluid chamber 3. Each pin can be moved from the active position to the inactive position manually by pushing the front face 14 of its pin body 11. While no force is applied to the pin in the ways described above the pin is held in either the active position or the inactive position by friction.

If the pin 1 being in the active position is accidentally bent by a radial shock and stuck in the bore 4 as described above it can be removed to the front by applying a force to the pin 1 which directed to the front and which is greater than the force applied by pressurized fluid in the fluid chamber 3 in normal operation. The force which can be applied from the fluid chamber 3 by using a backing-out punch after the removal of the rearward covering 6. The bent pin can be pulled out of the jaw 7 from the front instead by using nippers for example. As the result in both cases the O-ring-seal 17 is sheared off and may provide an additional inner surface 24 after the separation of some material. The pin body 11 which may still be carrying another part of the O-ring-seal 17 in the ring groove 16 is pushed or pulled through the bore 4 and out of the jaw 7. The remnant of the O-ring-seal 17 remains in the fluid chamber 3 and can be removed from the back and be replaced by a new pin 1.

Figure 7:
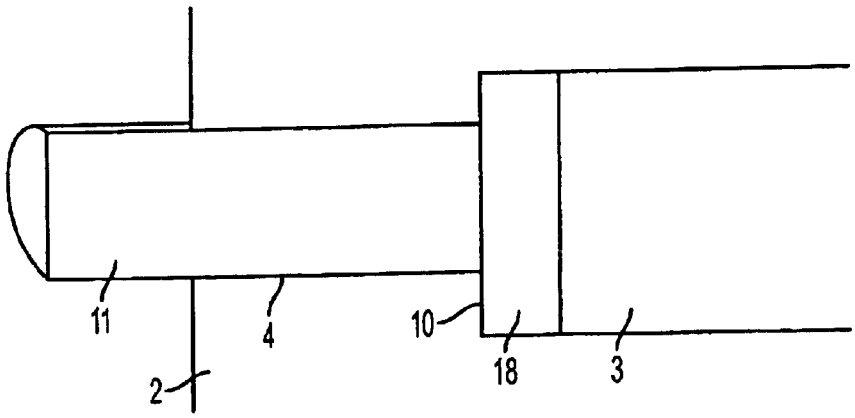
FIG. 7 is a sectional view of a positioning pin of the second embodiment of the present invention, the pin being in its active position.
Figure 8:
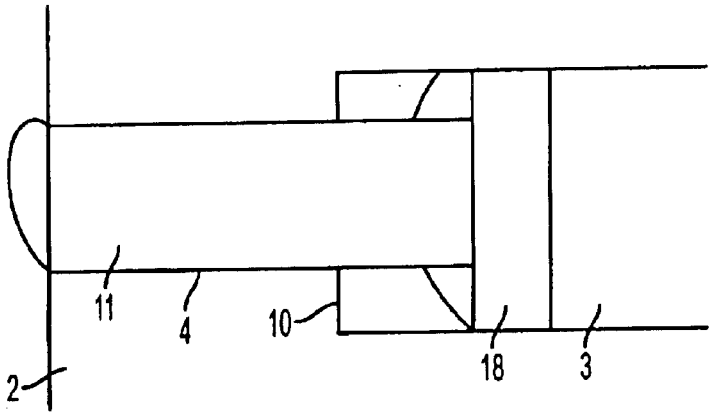
FIG. 8 is a sectional view of the pin of FIG. 7 in its inactive position.
Figure 9:
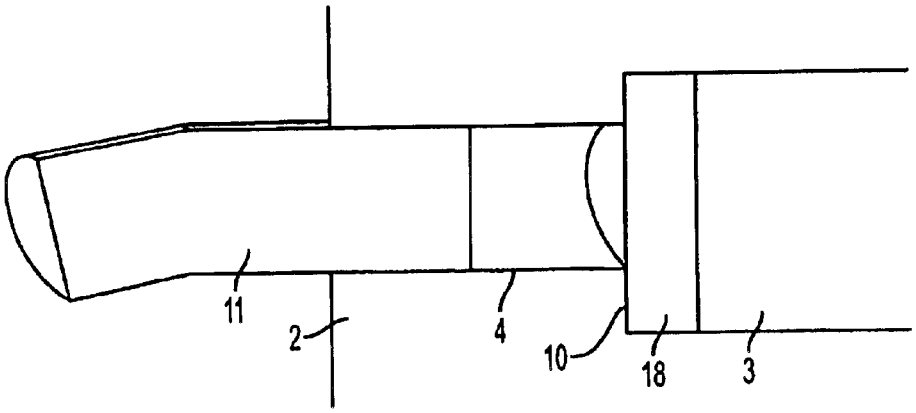
FIG. 9 is a sectional view of the pin of FIG. 7 being bent and removed from the bore by a force applied to the pin body and directed to the front, the disk being separated from the pin body.

The second embodiment of the present invention is shown in FIGS. 7, 8 and 9. It comprises a jaw 107 which is identical with the jaw 7. All elements of the second embodiment which are also part of the first embodiment have got numbers resulting from adding 100 to the numbers of the corresponding elements of the first embodiment described above. The second embodiment of the present invention comprises a plurality of positioning pins which provide a pin body 111 and a stop member 112 each. The pin body 111 is made of steel, cylindric and providing a diameter which is somewhat smaller than the diameter of the bores 104. It is adapted to be slidably received in one of the bores 104. The pin body 111 is longer than the bore 104 and does not provide a shoulder as known from the prior art or any other part which is exceeding an imaginary enveloping cylindric surface 113 being the axial prolongation of the bore 104. The pin body 111 provides a front face 114 at its front end and a rearward face 115 at its rearward end. A cylindric disk 118 which is made of polymer plastics or a metal and providing a diameter somewhat smaller than the diameter of the fluid chamber 103 and which is adapted to be slidably received in the fluid chamber 103 is concentrically glued to the rearward face 115 of the pin body 111 or otherwise removably attached thereto. The connection of the pin body 101 and the disk 118 is weaker than the disk itself and may be destroyed by the application of a force greater than the force applied by the pressurized fluid.

In normal operation one pin 101 is located in each bore 104. A part of the pin body 111 is located in the bore 104 and slidably received therein. The rearward face 115 of the pin carrying the disk 118 is located in the fluid chamber 103, the disk 118 slidably received therein. The pin 101 can be shifted at least between an active position and an inactive position. In the active position the front end of the pin body 111 is projected out of the bore exceeding the front face 108 of the jaw 107. The disk 118 is in contact with the transition section 110. In the inactive position the front face 114 of the pin body 111 is located in the plane defined by the front face 108 of the jaw 107. The disk 118 is not in contact with the transition section 110.

The pins can be moved from the inactive position to the active position by pressurized fluid in the fluid chambers 103. A source of pressurized fluid, for example pressurized air, can be connected to one of the fluid channels 105 to pressurize one row of fluid chambers 103. As the result all pins associated therewith are pushed into the active position by the force applied to the disk 118 by pressurized fluid in the fluid chamber 103. Each pin 101 can be moved from the active position to the inactive position manually by pushing the front face 114 of its pin body 111. While no force is applied to the pin 101 in the ways described above the pin is held in either the active position or the inactive position by friction.

If the pin being in the active position is bent by a radial shock and stuck in the bore 104 as described above it can be removed to the front by applying a force to the pin 101 which directed to the front and which is greater than the force applied by pressurized fluid in the fluid chamber 103 in normal operation. The force can be applied from the fluid chamber 103 by using a backing-out punch after the removal of the rearward covering 106. As the result the disk 118 or the connection between the disk 118 and the pin body 111 is destroyed and the pin body 111 is pushed through the bore 104 and out of the jaw 107. The bent pin can be pulled out of the jaw 107 from the front instead by using nippers for example. As the result the pin body 111 is separated from the disk 118, which is held at the transition section 110, and pulled out of the jaw 107. In both cases the disk 118 or at least a part of it remains in the fluid chamber 103 and can be removed from the back and be replaced by a new pin 101.

Figure 10:
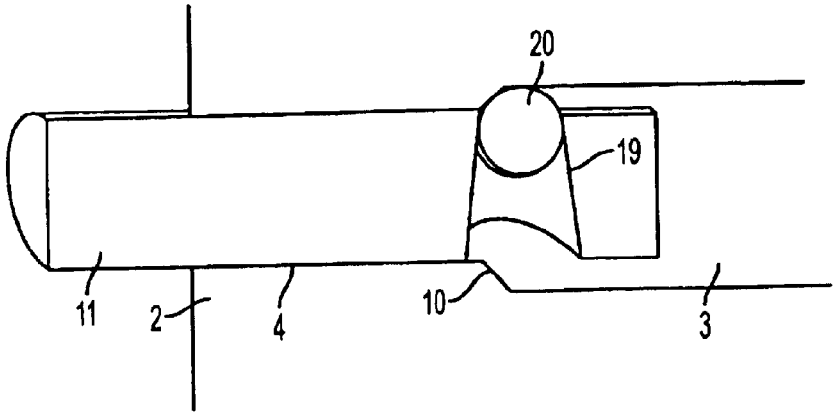
FIG. 10 is a sectional view of a positioning pin of the third embodiment of the present invention, the pin being in its active position.
Figure 11:
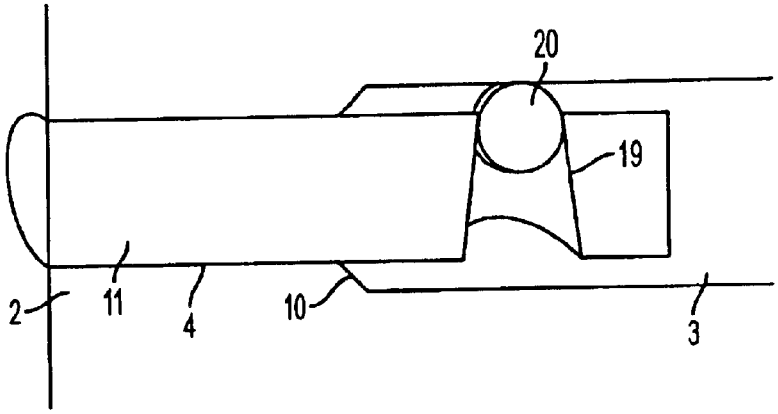
FIG. 11 is a sectional view of the pin of FIG. 10 in its inactive position.
Figure 12:
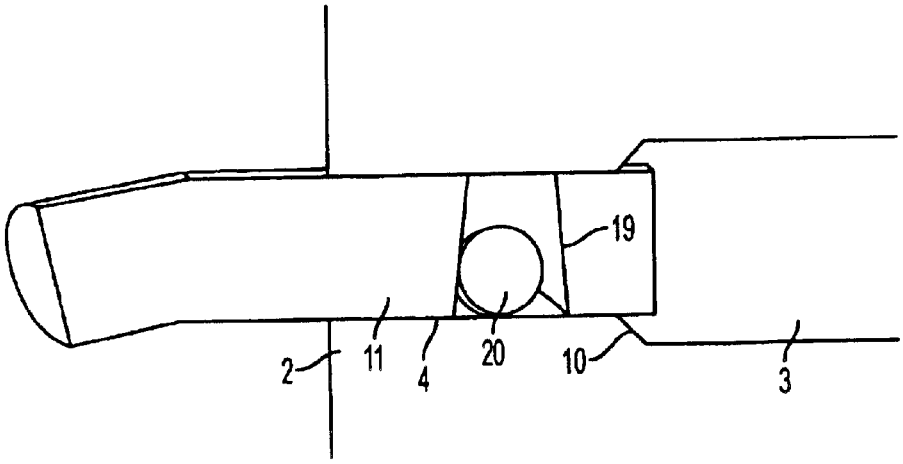
FIG. 12 is a sectional view of the pin of FIG. 10 being bent and removed from the bore by a force applied to the pin body and directed to the front, the ball being pressed into the bore in the pin body.
Figure 13:
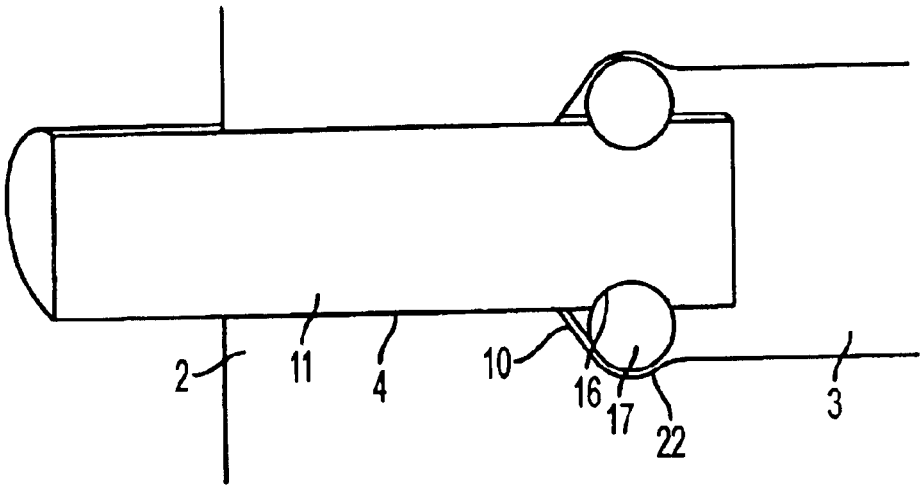
FIG. 13 is sectional view of one bore, the associated fluid chamber, a conical transition and a ring groove between fluid chamber and transition section holding a pin carrying an O-ring-seal in its active position by snap action.

The third embodiment of the present invention is shown in FIGS. 10, 11 and 12. All elements of the third embodiment which are also part of the first embodiment have got numbers resulting from adding 200 to the number of the corresponding element of the first embodiment described above. The third embodiment comprises a jaw 207 which is identical with the jaw 7 except the shape of the transition section 210 located between the bore 204 and the fluid chamber 203, which is conical instead of radial. The third embodiment of the present invention comprises a plurality of positioning pins 201 which provide a pin body 211 and a stop member 212 each. The pin body 211 is made of steel, cylindric and providing a diameter which is somewhat smaller than the diameter of the bores 204. It is adapted to be slidably received in one of the bores 204. The pin body 211 is longer than the bore 204 and does not provide a shoulder as known from the prior art or any other part which is exceeding an imaginary enveloping cylindric surface 213. The pin body 211 provides a front face 214 at its front end and a rearward face 215 at its rearward end. Next to the rearward end the pin body 211 provides a central, cylindrical or preferably conical through bore 219, the axis of the bore 219 being rectangular with the axis of the cylindric pin body 211. The third embodiment of the present 1invention provides a ball 220 which is made of steel as a stop member 212. The ball is providing a diameter which is somewhat greater than the diameter of the smaller opening of the conical through bore 219 and which is smaller than the diameter of the wider opening of the conical through bore 219. The ball 220 is adapted to be fixed in the conical bore 219 as a press-fitting. A part of the ball 220 passes the smaller opening of the conical through bore 219 and exceeds the enveloping cylindric surface 213.

In normal operation one pin 201 is located in each bore. A part of the pin body 211 is located in the bore 204 and slidably received therein. The rearward end of the pin 201 carrying the ball 220 is located in the fluid chamber 203, the ball 220 slidably received therein. The pin 201 can be shifted at least between an active position and an inactive position. In the active position the front end of the pin body 211 is projected out of the bore 204 exceeding the front face 208 of the jaw 207. The ball 220 is in contact with the conical transition section 210. In the inactive position the front face 214 of the pin body 211 is located in the plane defined by the front face 208 of the jaw 207. The ball 220 is not in contact with the transition section 210.

If the pin 201 being in the active position is bent by a radial shock and stuck in the bore 204 as described above it can be removed to the front by applying a force to the pin 201 which directed to the front and which is greater than the force applied by pressurized fluid in the fluid chamber 203 in normal operation. The force can be applied from the fluid chamber 203 by using a backing-out punch after the removal of the rearward covering 206. As the result the ball 220 touches the conical transition section 210 and is pushed out of its press-fitting into the conical through bore 219, remaining in a wider part thereof and no longer exceeding the enveloping cylindric surface 213. The whole pin can be pushed out of the front face 208 of the jaw 207 and can be replaced by a new pin 201 from the back.

A workpiece can be clamped between the jaws of a vise in a defined position easily when it is supported by positioning pins. They are located in a plurality of bores in the jaw and can be projected out of the jaw in operation. The pins comprise a pin body and a stop member. Both elements provide a shape which allows an economical production and easy connection with each other. In normal operation the pins can be projected out of the jaw by fluid pressure and be pushed back manually. A bent pin can be pushed or pulled to the front out of the jaw easily by destroying the stop member in a predetermined way or separating it from the pin body.

I claim:

1. A device for positioning a workpiece in retaining devices with at least one main body and positioning pins, the main body having at least one front face which is adapted to directly clamp a workpiece and which has bores passing through it, the bores opening into fluid chambers which are formed in the main body and have a larger diameter than the bores defining transition sections between the bores and the fluid chambers, with positioning pins which are disposed in the bores and are mounted so as to be movable at least between an active position in which they project out of the bores and an inactive position in which they do not project out of the bores, the positioning pins being movable by pressurized fluid in the fluid chambers out of their inactive position into their active position, at least one fluid channel provided in or at the main body for delivering the pressurized fluid to the fluid chambers, the fluid chambers are connected to one of the fluid channels each, so that by supply of the pressurized fluid, the positioning pins move out of their inactive position into their active position in which they project out of the front face of the main body, whereas they are to be moved back from their active position to their inactive position manually, so that for the purpose of positioning after the positioning pins have been moved out, the positioning pins which are not required are pushed back manually, each of the positioning pins comprises a one-piece pin body, which has a cylindrical section slidably received in one of the bores, which is longer than the bore, and which is no larger in a radial direction than an inner surface of the bore, a separate stop member, which is connected to the pin body and located in the fluid chamber, and which prevents the pin from exceeding the active position when moving from the inactive position to the active position by providing a shape, which is larger in the radial direction than the inner surface of the bore, and which stops movement of the positioning pin when touching the transition section between the fluid chamber and the bore, the pin body being removable from the bore to the front by exceeding the active position by force without damaging the main body, when a destructive force directed to the front is applied to the pin body, which is greater than a force necessary to destroy the pin or separate the stop member from the pin body.

2. A positioning pin of claim 1, wherein a part of the stop member is received in a cavity within the pin body, and wherein the shape of the stop member that is larger in the radial direction than the inner surface of the bore is sheared off, when the destructive force is applied to the pin body.

3. A positioning pin of claim 2, wherein said cavity is a ring groove of the pin body.

4. A positioning pin of claim 2, wherein the stop member is tubular.

5. A positioning pin of claim 4, wherein the stop member is an O-ring-seal.

6. A positioning pin of claim 2, wherein the stop member is made of polymer.

7. A positioning pin of claim 1 wherein the stop member is attached to the pin body and can be separated from the pin body, when the destructive force is applied to the pin body.

8. A positioning pin of claim 7, wherein the pin body is cylindrical and the stop member is a disk attached to the rearward face of the pin body, the disk being slidably received in the fluid chamber.

9. A positioning pin of claim 7, wherein the pin body is cylindrical and the stop member is attached to the lateral surface of the pin body, the stop member being slidably received in the fluid chamber.

10. A positioning pin of claim 7, wherein the stop member is glued to the pin body.

11. A positioning pin of claim 1 wherein the stop member can be pressed into the bore, when force at least as great as the destructive force is applied to the pin body.

12. A positioning pin is of claim 11 wherein the pin body is cylindrical, providing a cavity adapted to receive the stop member.

13. A positioning pin of claim 12 wherein said cavity is a through bore in the pin body.

14. A positioning pin of claim 13 wherein said bore is a conical.

15. A positioning pin of claim 13 wherein said bore is cylindrical.

16. A positioning pin of claim 12 wherein said cavity is a blind bore in the pin body.

17. A positioning pin of claim 11 wherein the stop member is a ball.

18. A positioning pin of claim 11 wherein the stop member is made of metal.

19. A main body of claim 1 wherein the transition section between each fluid chamber and the associated bore is a truncated cone.

20. A main body of claim 1 wherein the transition section between each fluid chamber and the associated bore is a radial surface forming a shoulder.

21. A main body of claim 1 providing a ring groove between each fluid chamber and the associated transition section.

22. A main body of claim 21 wherein the ring groove is adapted to the stop member holding the pin in its active position by snap action.

23. A main body of claim 1 wherein the bores are arranged in parallel, equidistant lines and the bores within each line are equidistant.

24. The device of claim 1, wherein the at least one fluid channel is for connecting to a source of the pressurized fluid such that a total amount of pressurized fluid in the device is changeable during use of the device.

25. The device of claim 1, wherein the at least one fluid channel is for connecting to an external fluid source.

* * * * *